US007921915B2

(12) United States Patent
Richard et al.

(10) Patent No.: US 7,921,915 B2
(45) Date of Patent: Apr. 12, 2011

(54) REMOVABLE INJECTION OR PRODUCTION FLOW EQUALIZATION VALVE

(75) Inventors: Bennett M. Richard, Kingwood, TX (US); Michael H. Johnson, Katy, TX (US); Sean L. Gaudette, Katy, TX (US)

(73) Assignee: Baker Hughes Incorporated, Houston, TX (US)

( * ) Notice: Subject to any disclaimer, the term of this patent is extended or adjusted under 35 U.S.C. 154(b) by 164 days.

(21) Appl. No.: 11/758,144

(22) Filed: Jun. 5, 2007

(65) Prior Publication Data

US 2008/0302533 A1 Dec. 11, 2008

(51) Int. Cl.
*E21B 34/14* (2006.01)

(52) U.S. Cl. ..... 166/334.4; 166/386

(58) Field of Classification Search ..... 166/227, 166/321, 332.1, 332.4, 332.5, 334.1, 334.4, 166/386, 322; 137/315.02
See application file for complete search history.

(56) References Cited

U.S. PATENT DOCUMENTS

| | | | | | |
|---|---|---|---|---|---|
| 2,230,107 | A | * | 1/1941 | Udell | 417/109 |
| 2,353,652 | A | * | 7/1944 | Coonrod | 166/106 |
| 3,151,681 | A | * | 10/1964 | Cochran | 166/332.4 |
| 3,827,491 | A | * | 8/1974 | Dinning | 166/154 |
| 4,129,184 | A | * | 12/1978 | Parker | 166/385 |
| 4,270,606 | A | | 6/1981 | McStravick et al. | |
| 4,399,871 | A | | 8/1983 | Adkins et al. | |
| 4,458,751 | A | | 7/1984 | Haynes | |
| 4,465,139 | A | * | 8/1984 | Marquez et al. | 166/373 |
| 4,640,355 | A | | 2/1987 | Hong et al. | |
| 4,917,183 | A | | 4/1990 | Gaidry et al. | |
| 5,042,584 | A | | 8/1991 | Terral | |
| 5,211,241 | A | * | 5/1993 | Mashaw et al. | 166/320 |
| 5,263,683 | A | * | 11/1993 | Wong | 251/145 |
| 5,339,895 | A | | 8/1994 | Arterbury et al. | |
| 5,355,953 | A | * | 10/1994 | Shy et al. | 166/250.1 |
| 5,435,393 | A | * | 7/1995 | Brekke et al. | 166/370 |
| 5,706,891 | A | | 1/1998 | Schraub | |
| 5,718,289 | A | | 2/1998 | Schnatzmeyer et al. | |
| 5,810,083 | A | * | 9/1998 | Kilgore | 166/321 |
| 5,829,522 | A | | 11/1998 | Ross et al. | |

(Continued)

FOREIGN PATENT DOCUMENTS

GB 2250528 10/1992

OTHER PUBLICATIONS

Yousef, A.A., et al., "A Capacitance Model to infer Interwell Connectivity From Production and Injection Rate Fluctuations", SPE 95322, Oct. 1-19, 2005.

(Continued)

*Primary Examiner* — Shane Bomar
*Assistant Examiner* — Blake Michener
(74) *Attorney, Agent, or Firm* — Steve Rosenblatt

(57) ABSTRACT

One or more valves can be run into a string to land near associated ports in the string for injection or/and production service. When multiple valves are installed they can be initially configured to balance flow into or from a zone. The position of each valve can be altered without removal from the string preferably by a wireline shifting tool. One or more valves can also be removed and replaced when worn preferably using a wireline run tool. The valves can come with an integral sand control feature to facilitate production. Sensors to monitor well conditions and to transmit data to the surface can also be incorporated into the valve module.

21 Claims, 2 Drawing Sheets

U.S. PATENT DOCUMENTS

| | | | | |
|---|---|---|---|---|
| 6,189,619 | B1 * | 2/2001 | Wyatt et al. | 166/332.1 |
| 6,266,619 | B1 | 7/2001 | Thomas et al. | |
| 6,273,194 | B1 * | 8/2001 | Hiron et al. | 166/373 |
| 6,318,465 | B1 | 11/2001 | Coon et al. | |
| 6,325,150 | B1 * | 12/2001 | Rayssiguier | 166/334.4 |
| 6,338,385 | B1 * | 1/2002 | Muchow | 166/194 |
| 6,371,208 | B1 * | 4/2002 | Norman et al. | 166/334.4 |
| 6,371,210 | B1 | 4/2002 | Bode et al. | |
| 6,422,317 | B1 * | 7/2002 | Williamson, Jr. | 166/374 |
| 6,481,494 | B1 | 11/2002 | Dusterhoft et al. | |
| 6,494,265 | B2 * | 12/2002 | Wilson et al. | 166/332.1 |
| 6,681,852 | B2 * | 1/2004 | Baskett et al. | 166/208 |
| 6,722,439 | B2 * | 4/2004 | Garay et al. | 166/373 |
| 6,817,416 | B2 * | 11/2004 | Wilson et al. | 166/332.1 |
| 6,966,380 | B2 * | 11/2005 | McLoughlin et al. | 166/320 |
| 6,978,840 | B2 | 12/2005 | Henderson | |
| 7,055,598 | B2 | 6/2006 | Ross et al. | |
| 7,096,945 | B2 | 8/2006 | Richards et al. | |
| 7,152,678 | B2 * | 12/2006 | Turner et al. | 166/373 |
| 7,413,022 | B2 * | 8/2008 | Broome et al. | 166/386 |
| 2002/0108755 | A1 | 8/2002 | Zisk | |
| 2002/0134554 | A1 | 9/2002 | Schrenkel et al. | |
| 2003/0056951 | A1 * | 3/2003 | Kaszuba | 166/250.01 |
| 2003/0132001 | A1 | 7/2003 | Wilson | |
| 2005/0199391 | A1 | 9/2005 | Cudmore et al. | |
| 2006/0124310 | A1 * | 6/2006 | Lopez de Cardenas et al. | 166/313 |
| 2006/0131033 | A1 | 6/2006 | Bode et al. | |
| 2006/0272814 | A1 | 12/2006 | Broome et al. | |
| 2007/0246212 | A1 * | 10/2007 | Richards | 166/227 |
| 2009/0044944 | A1 * | 2/2009 | Murray et al. | 166/308.1 |

OTHER PUBLICATIONS

Suri, Ajay, et al., "A Model for Water Injection Into Frac-Packed Wells", SPE 110084, Nov. 1-17, 2007.

* cited by examiner

REMOVABLE INJECTION OR PRODUCTION FLOW EQUALIZATION VALVE

FIELD OF THE INVENTION

The field of this invention is downhole systems that allow injection of fluids into the formation and/or production and more specifically valve systems that can balance flows over a zone or multiple zones with the added features of being adjustable while downhole, prevent intrusion of formation sand on down cycles and removable without pulling the string out of the hole.

BACKGROUND OF THE INVENTION

Injection is a process of sending water or steam, for example, into a well bore to stimulate production in an adjacent well bore. In some well bores multiple zones may be present which present problems of metering the desired quantities of injected fluids into the individual zones from a single tubing or casing string. Injection can require high pressures and flow rates, which means it generally involves high fluid velocities. High fluid velocities are detrimental to equipment such as valves through which the injected material is pumped. Some procedures take production after injection from the same well. In some instances, a gravel pack or other sand control means is used to prevent formation material from filling the well bore should injection be stopped or curtailed, or the well bore placed into a production mode.

Injection has in the past been performed through injection valves, some of which are also known as chokes. These valves were in the past made integral to the bottom hole assembly. If they wore out the string had to be pulled to get them out. Some were mounted into side pocket mandrels. The problem with side pocket mandrels was that additional space was needed in the well to get the side pocket mandrel into the wellbore and that, in turn, required the use of a smaller valve and higher pump capacity at the surface to get the desired flow rates through a smaller valve. Additionally, the characteristics of the formation had to be anticipated when the string was made up so that the layout of several valves that were designed to balance the flow into the formation for injection or in the reverse direction, had to be fixed during string makeup. One alternative to this was to use a series of valves that could be manipulated from the surface through one or more control lines that ran to each valve. The problem with this approach was cost of the various control systems and lack of space in the well for all the control lines that were needed to be able to independently control each valve in attempting to match flow resistance at the valves to formation characteristics to get uniform flow in either direction to or from the surface string. One approach to balancing inflow from the formation, when using many screen sections, was to put a flow resistor together with each screen section when assembling the screen assemblies. Here again, the formation characteristics had to be anticipated so that greater resistance could be disposed where greater flows were expected. The resistance path was a spiral path and U.S. Pat. No. 6,222,794 illustrates that design and several alternatives. Screen sections have come with base pipe ports that could be opened or closed in a variety of ways. These systems were interested in opening or closing a screen segment to start or stop production from a given interval in a zone rather than to be used in balancing flow in a zone. These systems were integral to the bottom hole assembly with some having only open and closed capability while others could hold intermediate positions. Some examples of this approach are U.S. Pat. Nos. 6,371,210; 7,096,945; 7,055,598; 6,481,494 and 6,978,840. U.S. Pat. No. 4,399,871 shows a chemical injection valve with a bypass feature.

What is needed and not provided in the prior designs is a valve assembly that can be run in and secured through the string at a desired location. The valve can be adjusted between fully open and closed while secured without the use of control lines running outside the string. The valve can accommodate injection service and can come with a sand control feature to do double duty for injection and production. Position changes between open and closed and insertion and removal can be accomplished by wireline so that flow balancing can be quickly reconfigured to adapt to variable well conditions. These and other features of the present invention will be more apparent to those skilled in the art from a review of the description of the preferred embodiment and the associated drawings while recognizing that the claims define the full scope of the invention.

SUMMARY OF THE INVENTION

One or more valves can be run into a string to land near associated ports in the string for injection or/and production service. When multiple valves are installed they can be initially configured to balance flow into or from a zone. The position of each valve can be altered without removal from the string preferably by a wireline shifting tool. One or more valves can also be removed and replaced when worn preferably using a wireline run tool. The valves can come with an integral sand control feature to facilitate production. Sensors to monitor well conditions and to transmit data to the surface can also be incorporated into the valve module.

DETAILED DESCRIPTION OF THE PREFERRED EMBODIMENT

Figure 1:
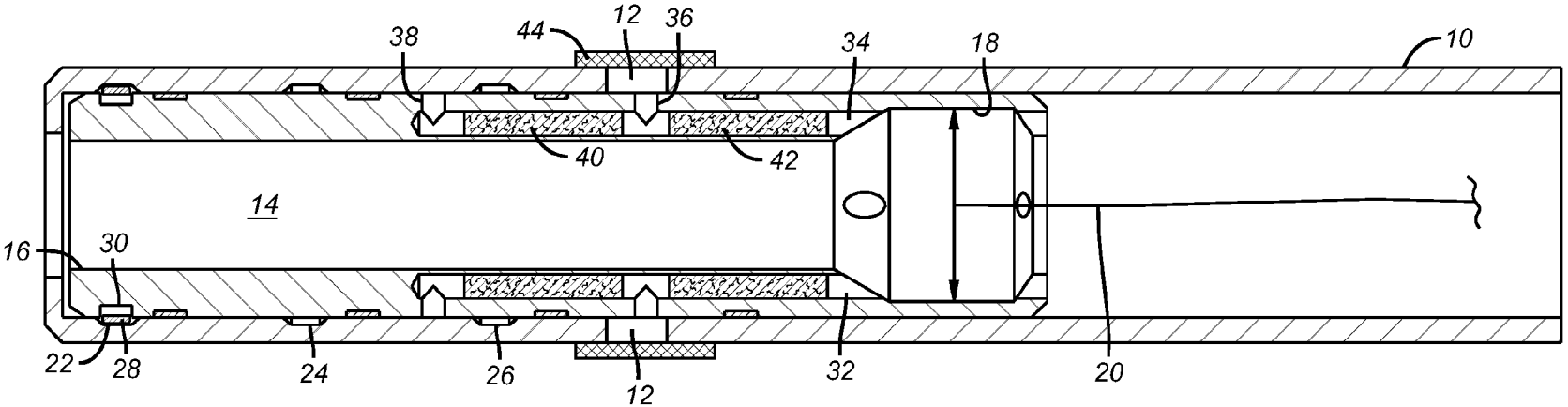
FIG. 1 is a section view of the insert valve assembly in a position where low restriction to flow is provided.

FIG. 1 illustrates schematically a portion of a tubular string 10 that has at least one but preferably a plurality of ports 12 only one of which is shown. A valve assembly 14 has a through passage 16 and an internal recess 18 where it may be grasped by a tool such as a wireline running tool schematically illustrated by arrow assembly 20. Associated with each port 12 along the tubular string 10 is a unique profile that allows the assembly 14 to be deployed in the positions shown in the FIGS. for initial string makeup and for subsequent manipulation when in the well using the schematically represented tool 20.

Figure 3:
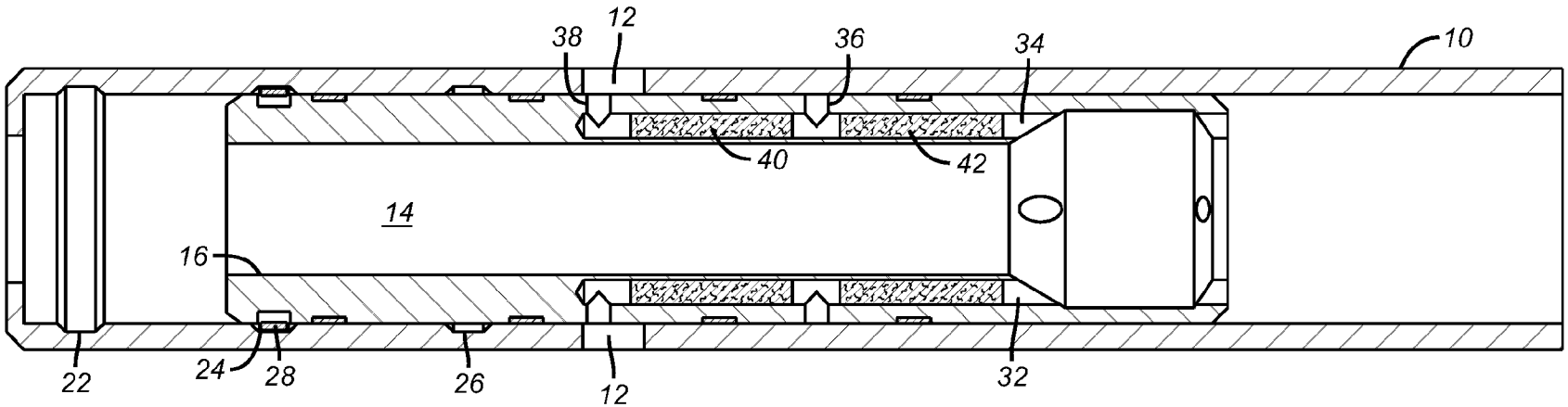
FIG. 3 is the view of FIG. 1 with the insert valve in a position where high restriction to flow is provided.

One purpose of associating a valve assembly 14 with a port 12 in a zone in the wellbore is to try to balance flow among the ports 12 regardless of the direction through those ports. When in the FIG. 1 or 3 positions the valve 14 can operate as an injection valve or a production valve. While two open positions are illustrated additional positions for flow are contemplated. In the preferred embodiment, the illustrated positions are accomplished by engaging a profile in the tubular that in one schematic embodiment that is shown in the drawings comprises grooves 22, 24 and 26 that correspond to the three illustrated positions of the preferred design. A snap ring or other type of locking device 28 rides in a groove 30 on the valve 14. The running tool 20 can exert a predetermined force on the valve 14 to force the snap ring or locking device 28 to collapse to allow the valve to shift in either direction to another predetermined position based on the placement of grooves such as 22, 24 and 26 or simply to be removed from the tubular 10.

Figure 2:
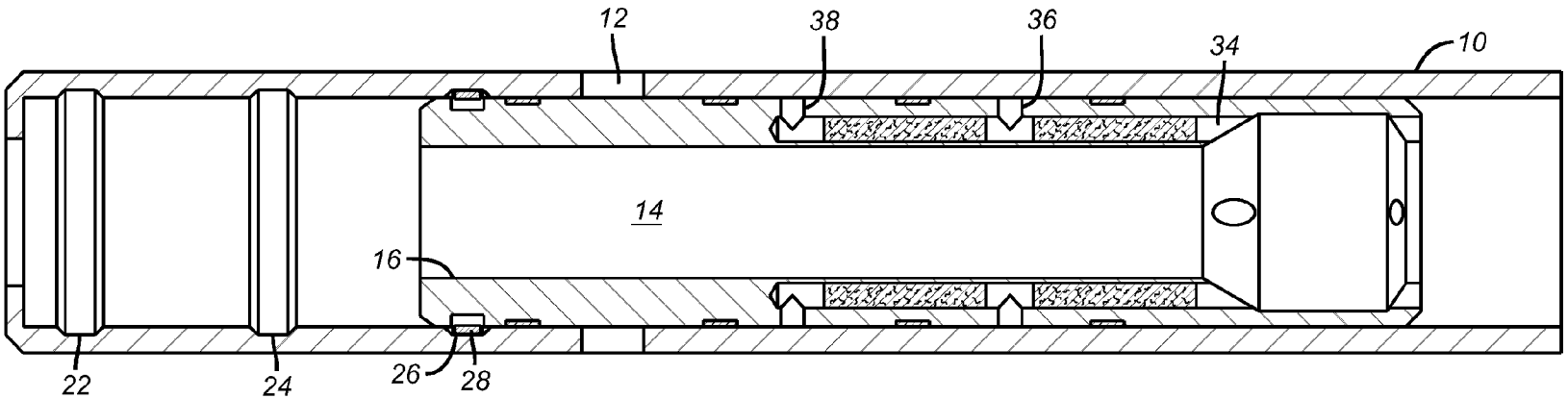
FIG. 2 is the view of FIG. 1 with the insert valve in a closed position.

Apart from the passage 16 that allows flow to go further down or up in the tubular 10 so that, for example in injection mode, the injection fluid can reach the other ports 12 in the tubular 10 there is also in the valve 14 one or more wall passages such as 32 and 34 each preferably with multiple outlets such as 36 and 38 that can be selectively aligned with a port 12 or totally misaligned for the closed position shown in FIG. 2. Located in passages 32 and 34 are filter segments such as 40 and 42. These segments are for the purpose of catching some produced solids in production mode or impurities in the injected fluid in injection mode. They can be made of sintered metal or material commonly used in gravel packing. Alternatively or additionally, a screen 44 can overly the ports 12 and can be prepacked for sand control or the annular space around it can be gravel packed in a known manner. Those skilled in the art will appreciate that in the FIG. 1 position flow through passages 32 and 34 will bypass filter segment 40 and will provide less resistance to flow through the valve 14 than the FIG. 3 position where flow through passages 32 and 34 must go through both filter segments 40 and 42. While two segments 40 and 42 are shown in series, additional segments in series can be used. Alternatively, the resistance to flow through a port 12 can be accomplished in other ways not necessarily requiring the assembly 14 to be shifted. For example different internal passages with different dimensions can be aligned for flow communication with port 12 by triggering a valve in any respective passage to open and another to close. This could be accomplished with a device that can be run in on wireline into passage 16 and communicate with internal valves to the various passages in valve 14 that may carry an on board power supply or could depend on the power delivered with the wireline run device to actuate to add or subtract resistance to flow or cut it off altogether. Alternatives to the snap ring or locking device system for changing the position of the valve 14 are also contemplated. The tubular 10 can have unique profiles adjacent each port 12 so that the valve will only land in a certain position while allowing it to also be extracted from that position so that a replacement that is configured to land differently at the same port can be run in after the original is removed.

Those skilled in the art can now appreciate that the system described has advantages. Flow distribution in injection or production mode need not be correctly guessed when the string is assembled. The flow resistance profile of a collection of valves 14 can be changed without removing them from the string 10. This can be done without control lines from the surface and one preferred way to make this change quickly is to insert a tool on wireline or slickline and reconfigure the flow regime through one or more valves 14. If any of the valves 14 wear out from effects of flowing fluid, the string 10 doesn't have to be pulled. Instead only the valves 14 above the one in question can be pulled to allow access to remove the one that needs replacing. The valves 14 are capable of service in injection with flow coming down from the surface to the valves 14 and out into the formation. Depending on the application and the amount of solids expected during production, the valves 14 can not only evenly distribute incoming production fluids into the string 10 but they also may provide sand control of the balanced production stream. As another option, the ports 12 can be covered with a screen 44 that can be prepacked or gravel packed with preferably coarser gravel with larger interstitial spacing so as to take the load off filter segments such as 40 and 42. The valves 14 can be put in different positions by moving them relative to the string 10 or moving internal components while leaving the housing stationary so as to select an open or closed position or one or more positions in between. Well data can be collected through sensors in the valve 14 and stored for later retrieval or for surface transmission in real time or periodically such as by lowering a sonde for capturing the stored data. The valves 14 need not be inserted in side pocket mandrels although that option is still possible. Any tubing string with ports 12 and some engagement profile adjacent each port for landing a valve 14 or moving it among its various positions with respect to a port 12 or to change its resistance to flow can be used. Dummy valves with no openings can be inserted to close of a portion of the interval.

The above description is illustrative of the preferred embodiment and many modifications may be made by those skilled in the art without departing from the invention whose scope is to be determined from the literal and equivalent scope of the claims below.

We claim:

1. An assembly for performing a subterranean operation through one or more ports in a tubular string, comprising:

at least one valve assembly having an outermost housing in contact with the tubular string and movably supportable in the tubular and releasable from within the tubular for removal through the tubular from the mounted subterranean position of said valve assembly; and said valve assembly housing movable between at least two different open positions and a closed position with respect to a port in the string, wherein each open position corresponds to a different length of filter in the assembly through which the operation is performed.

2. The assembly of claim 1, wherein:

said valve assembly allows flow into or out of the tubular string through said port.

3. An assembly for performing a downhole operation through one or more ports in a tubular string, comprising:

at least one valve assembly having an outermost housing in contact with the tubular string and movably supportable in the tubular and releasable for removal through the tubular; and said valve assembly housing movable between an open and closed position with respect to a port in the string;

said valve assembly comprises multiple openings which when aligned with the port present different resistance to flow through said valve assembly.

4. An assembly for performing a downhole operation through one or more ports in a tubular string, comprising:

at least one valve assembly movably supportable in the tubular and releasable for removal through the tubular; and said valve assembly movable between an open and closed position with respect to a port in the string;

said valve assembly comprises multiple openings which when aligned with the port present different resistance to flow through said valve assembly;

said openings are in flow communication with at least one common passage in said valve assembly that further comprises at least one filter therein.

5. An assembly for performing a downhole operation through one or more ports in a tubular string, comprising:

at least one valve assembly supportable in the tubular and releasable for removal through the tubular; and said valve assembly movable between an open and closed position with respect to a port in the string;

said valve assembly comprises multiple openings which when aligned with the port present different resistance to flow through said valve assembly;

said openings are in flow communication with at least one common passage in said valve assembly that further comprises at least one filter therein;

said at least one filter comprises a plurality of filters and the different resistance to flow is accomplished by alignment of different said openings in the valve assembly with the port so as to force flow through differing numbers of filters in series through said at least one common passage.

6. An assembly for performing a downhole operation through one or more ports in a tubular string, comprising:

at least one valve assembly supportable in the tubular and releasable for removal through the tubular; and said valve assembly movable between an open and closed position with respect to a port in the string;

said valve assembly comprises multiple openings which when aligned with the port present different resistance to flow through said valve assembly;

said valve assembly is shiftable while in the tubular for support in the tubular in a plurality of positions to align or misalign at least one opening with the port.

7. The assembly of claim 6, wherein:

said valve assembly further comprises a locking device that can support said valve assembly in a plurality of positions when said locking device is allowed to selectively engage the tubular.

8. An assembly for performing a downhole operation through one or more ports in a tubular string, comprising:

at least one valve assembly supportable in the tubular and releasable for removal through the tubular; and said valve assembly movable between an open and closed position with respect to a port in the string;

said at least one valve assembly comprises a plurality of valve assemblies each having a passage therethrough and each having a plurality of openings selectively aligned with a respective port in the tubular and wherein different resistance to flow can exist at different ports.

9. The assembly of claim 8, wherein:

each valve assembly comprises multiple openings leading to at least one second passage wherein alignment of different openings with the port results in different flow resistance through said second passage.

10. The assembly of claim 8, wherein:

said passage in one valve assembly allows a tool to pass through to move another valve assembly; and an internal recess on at least one valve assembly to allow it to be gripped by a tool and moved.

11. An assembly for performing a downhole operation through one or more ports in a tubular string, comprising:

at least one valve assembly supportable in the tubular and releasable for removal through the tubular;

said valve assembly movable between an open and closed position with respect to a port in the string;

said at least one valve assembly comprises a plurality of valve assemblies each having a passage therethrough and each having a plurality of openings selectively aligned with a respective port in the tubular and wherein different resistance to flow can exist at different ports;

each valve assembly comprises multiple openings leading to at least one second passage wherein alignment of different openings with the port results in different flow resistance through said second passage;

said second passage comprises a plurality of filter elements and a change of alignment of openings to the port allows flow to bypass at least one of said filter elements.

12. An assembly for performing a downhole operation through one or more ports in a tubular string, comprising:

at least one movable valve assembly supportable in the tubular;

said valve assembly comprises a plurality of filtered passages having associated lateral openings each of which openings present a different pressure drop in a path selectively aligned to a port in the tubular;

said valve assembly further comprising a through passage.

13. The assembly of claim 12, wherein:

said valve assembly allows flow into or out of the tubular string through said port.

14. The assembly of claim 12, wherein:

said at least one filtered opening comprises multiple filtered openings which when aligned with the port present different resistance to flow through said valve assembly.

15. The assembly of claim 12, wherein:

said at least one valve assembly comprises a plurality of valve assemblies each having a passage therethrough and each having a plurality of filtered openings selectively aligned with a respective port in the tubular and wherein different resistance to flow can exist at different ports.

16. The assembly of claim 15, wherein:

said multiple filtered openings are in fluid communication with at least one second passage on said valve assembly wherein alignment of different filtered openings on said valve assembly with the port results in different flow resistance through said second passage.

17. An assembly for performing a downhole operation through one or more ports in a tubular string, comprising:

at least one valve assembly supportable in the tubular;

said valve assembly comprises at least one filtered lateral opening movable with said valve assembly between an open and closed position with respect to a port in the string;

said valve assembly further comprising a through passage;

said at least one filtered opening comprises multiple filtered openings which when aligned with the port present different resistance to flow through said valve assembly;

said openings are in flow communication with at least one common passage;

said filtered lateral openings further comprise a plurality of filters in said common passage wherein alignment of different openings with the port allows bypassing of at least one filter in said common passage.

18. The assembly of claim 17, wherein:

said valve assembly is shiftable while in the tubular for support in the tubular in a plurality of positions to align or misalign said filtered lateral openings with the port.

19. The assembly of claim 18, wherein:

said valve assembly further comprises a locking device that can support said valve assembly in a plurality of positions when said locking device is allowed to selectively engage the tubular.

20. An assembly for performing a downhole operation through one or more ports in a tubular string, comprising:

at least one valve assembly supportable in the tubular;

said valve assembly comprises at least one filtered lateral opening movable with said valve assembly between an open and closed position with respect to a port in the string;

said valve assembly further comprising a through passage;

said at least one valve assembly comprises a plurality of valve assemblies each having a passage therethrough and each having a plurality of filtered openings selectively aligned with a respective port in the tubular and wherein different resistance to flow can exist at different ports;

said multiple filtered openings are in fluid communication with at least one second passage on said valve assembly wherein alignment of different filtered openings on said valve assembly with the port results in different flow resistance through said second passage;

said second passage on said valve assembly comprises a plurality of filter elements associated with said filtered openings and a change of alignment of filtered openings to the port in the tubular string allows flow to bypass at least one of said filter elements in said second passage.

21. The assembly of claim 20, wherein:

said passage in one valve assembly allows a tool to pass through to move another valve assembly; and an internal recess on at least one valve assembly which allows it to be gripped by a tool and moved.

* * * * *